United States Patent [19]

Szloboda

[11] Patent Number: 4,683,853

[45] Date of Patent: Aug. 4, 1987

[54] VACUUM OPERATED APPARATUS FOR CONTROLLING THE IGNITION TIMING OF AN ENGINE

[76] Inventor: Samuel Szloboda, 10640 Skagit Dr., Richmond, British Columbia, Canada, V7E 2A2

[21] Appl. No.: 3,659

[22] Filed: Jan. 15, 1987

[30] Foreign Application Priority Data

Jul. 24, 1986 [CA] Canada ..... 514591

[51] Int. Cl.[4] ..... F02P 5/12

[52] U.S. Cl. ..... 123/407

[58] Field of Search ..... 123/407, 408, 409, 525

[56] References Cited

U.S. PATENT DOCUMENTS

| | | | |
|---|---|---|---|
| 3,329,136 | 7/1967 | Cadiou | 123/407 |
| 3,478,729 | 11/1969 | Toda | 123/407 |
| 3,730,154 | 5/1973 | Vartanian | 123/409 |
| 4,399,780 | 8/1983 | Lassanske et al. | 123/525 X |
| 4,622,937 | 11/1986 | Szloboda | 123/407 |

*Primary Examiner*—Tony M. Argenbright

*Attorney, Agent, or Firm*—Roylance, Abrams, Berdo & Goodman

[57] ABSTRACT

Vacuum operated apparatus for controlling the ignition timing of an engine, which apparatus comprises valve means and first, second and third conduit means, the valve means comprising a valve body, a first chamber, first and second port in the first chamber, first obturator means for opening and closing the second port, a second chamber, third and fourth ports in the second chamber, and second obturator means for opening and closing the fourth port, and passageway means which connects together inside the valve body the second and the third ports, the first conduit means being for connecting the first port to an engine inlet manifold, the third conduit being for connecting the third parts to an engine carburettor, and the second conduit means being for connecting the second and the fourth ports via the passageway means to an engine distributor arrangement, and the apparatus being such that in use the valve means receives first vacuum forces from the inlet manifold via the first conduit means and second vacuum forces from the carburettor via the third conduit means, the valve means being operative to transmit the greater of the first and the second vacuum forces via the second and the fourth ports, and the second conduit means to the engine distributor arrangement so that the engine distributor arrangement always receives the optimum vacuum force for causing the optimum adjustment of the engine distributor arrangement to give the optimum engine ignition timing during engine operating conditions.

9 Claims, 3 Drawing Figures

VACUUM OPERATED APPARATUS FOR CONTROLLING THE IGNITION TIMING OF AN ENGINE

This invention relates to vacuum operated apparatus for controlling the ignition timing of an engine.

Since its beginning, the vehicle industry has been researching and experimenting in an endeavour to find better ignition timing systems for engines. Although electronic spark distributors have recently been developed, these distributors have met with little commercial acceptance and, at the present time, the advancing and retarding of a spark to give the required ignition timing is mostly achieved using well known mechanically operating distributors. The mechanically operating distributors are manually set to the basic ignition timing required by the engine. This basic ignition timing is then finely adjusted during engine operating conditions by utilising the variable vacuum that occurs in the carburettor of the vehicle. This variable vacuum is transmitted to the mechanically operating distributors and causes them to finely adjust the ignition timing consequent upon the engine operating conditions.

In recent years and due to fuel shortages and rising fuel costs, more and more people have been converting their vehicles to run on gaseous fuel instead of the usual liquid fuel such as gasolene. The gaseous fuel is sometimes known as liquid petroleum gas and it may be a liquid propane gas or natural gas. Other gaseous fuels may be employed. All the gaseous fuels give rise to a common problem that presents itself when the engine is converted from running on liquid fuel to gaseous fuel. The problem is especially acute where engines are modified such that they are capable of using either liquid fuel or gaseous fuel, depending upon which fuel is available. The problem is that liquid and gaseous fuels have different flashing points with liquid fuel having a lower flashing point than gaseous fuel. These different flashing points require different ignition timing for obtaining optimum engine performance, for example optimum engine power and/or optimum engine fuel consumption. Thus, for an engine that is to be converted from operating solely on liquid fuel to operating on liquid fuel or gaseous fuel as required, two separate ignition timing parameters are required, one to take in to account the lower flashing point of the liquid fuel and the other to take into account the higher flashing point of the gaseous fuel.

An attempt to meet the above problem has been made in the vehicle gas conversions industry, which is the industry that is currently employed in converting vehicles to run on gaseous fuel. The vehicle gas conversions industry refer to the requirement of a dual spark curve, and an electrical device has been developed to give this dual spark curve. The electrical device is expensive and it also requires considerably different installation on different makes of car. In view of the many available makes of car at present available, the installation instructions are complex and varied for different makes of car and very few mechanics know how satisfactorily to install the electronic device. This in turn has caused confusion and dissatisfaction amongst customers.

In U.S. Pat. No. 4,622,937 to David T. Szloboda, there is described and claimed vacuum operated apparatus which is better than the above mentioned electrical device in that the vacuum operated apparatus is simple to manufacture and instal and yet also facilitates effective control of the ignition timing of an engine.

It is an aim of the present invention to provide vacuum operated apparatus which operates on the same principle as the vacuum operated apparatus of U.S. Pat. No. 4,622,937 but which is constructed in a different way so that only three conduit means need to be employed to connect up the valve means forming part of the vacuum operated apparatus, instead of the four conduit means required in U.S. Pat. No. 4,622,937

Accordingly, this invention provides vacuum operated apparatus for controlling the ignition timing of an engine, which apparatus comprises valve means and first, second and third conduit means, the valve means comprising a valve body, a first chamber, first and second ports in the first chamber, first obturator means for opening and closing the second port, a second chamber, third and fourth ports in the second chamber, second obturator means for opening and closing the fourth port, and passageway means which connects together inside the body the second and the third ports, the first conduit means being for connecting the first port to an engine inlet manifold, the third conduit means being for connecting the third port to an engine carburettor, and the second conduit means being for connecting the second and fourth port via the passageway means to an engine distributor arrangement, and the apparatus being such that in use the valve means receives first vacuum forces from the inlet manifold via the first conduit means and second vacuum forces from the carburettor via the third conduit means, the valve means being operative to transmit the greater of the first and the second vacuum forces via the second and the fourth ports and the second conduit means to the engine distributor arrangement so that the engine distributor arrangement always receives the optimum vacuum force for causing the optimum adjustment of the engine distributor arrangement to give the optimum engine ignition timing during engine operating conditions.

The vacuum operated apparatus of the invention can be produced very cheaply. It may greatly increase fuel efficiency, increase engine power, and considerably reduce engine pollution emissions when the engine is operating on either a liquid fuel or a gaseous fuel.

Whereas the existing vacuum operated types of apparatus for controlling the ignition timing of an engine just rely on one vacuum source provided by the carburettor, the vacuum operated apparatus of the present invention uses two different vacuum sources, one being the vacuum source from the usual carburettor and the other being the vacuum source from the manifold. This is advantageous because if only one vacuum source from the carburettor is used, as in the known types of vacuum operated apparatus, there will be no or poor ignition timing adjustment at low engine revolutions per minute when there is either no vacuum or only a very small vacuum in the carburettor. The present invention utilises the fact that the vacuum in the manifold, for example, just below the carburettor, is highest at engine idling speed and it decreases with engine acceleration. With engine acceleration, the vacuum in the carburettor can then be used because with engine acceleration, the vacuum in the carburettor increases. Thus, the vacuum operated apparatus of the present invention utilises two variable vacuums from two vacuum sources, and the engine distributor arrangement can be fed with the greater of these variable vacuums to give the most advantageous ignition timing adjustment.

Preferably, the vacuum operated apparatus is one in which the first and the third ports are formed in first and third nipples, in which a second nipple is provided for the passageway means and the second and the fourth ports, and in which all of the nipples are such as to extend from the body of the valve means.

The first and the second obturator means are each advantageously a flap operating obturator device.

The valve body may have a pair of end members which press into a main body part to close a pair of recesses in the body and thereby to form the first and the second chambers, the flap operating obturator devices each having a peripheral portion which is trapped between one of the pair of the end members and the main body part, and a flap part which operates one against each of a pair of open ends of the passageway means.

Usually, the first conduit means will include a valve for opening or closing the first conduit means. This enables the vacuum from the manifold to be used or shut off as desired.

The valve for the first conduit means may be an electrically operated valve. A presently preferred electrically operated valve is a solenoid. Other types of valve including mechanically operating valves may be employed.

The vacuum operated apparatus may include auxiliary air inlet means. The auxiliary air inlet means may be employed to eliminate any possibility of a vacuum lock occuring in the valve means and also to help ensure that there is no hesitation in the variation of the vacuum fed to the distributor whereby ignition adjustment such as spark advancement occurs smoothly and continuously.

The auxiliary air inlet means may be an air inlet port provided in the valve means. The air inlet port may be provided in the valve body or in one of the nipples.

The engine distributor arrangement may comprise an electrically operated distributor and a vacuum advance potentiometer, the second conduit means being for connection to the vacuum advance potentiometer.

An embodiment of the invention will now be described solely by way of example and with reference to the accompanying drawings in which.

Figure 1:
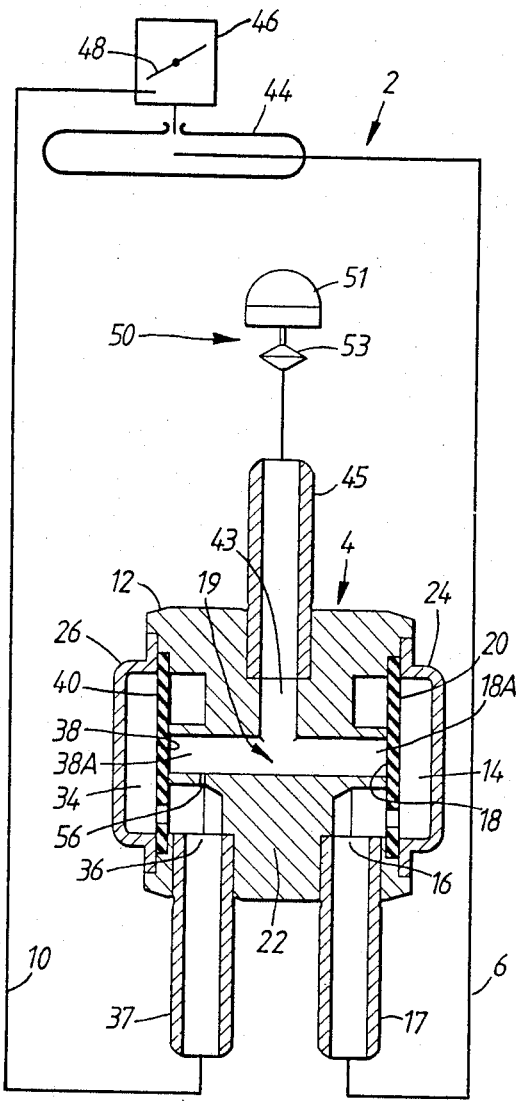
FIG. 1 shows vacuum operated apparatus for controlling the ignition timing of an engine.
Figure 3:
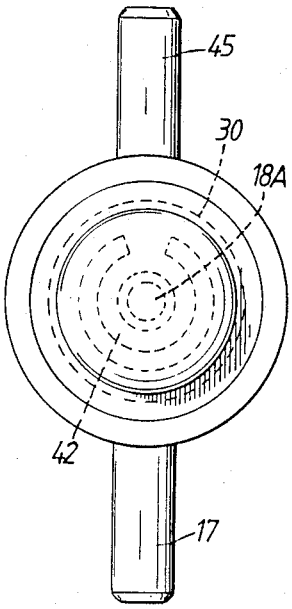
FIG. 3 is an end view of the valve means shown in FIG. 1.

Referring to the drawings, there is shown vacuum operated apparatus 2 for controlling the ignition timing of an engine. The apparatus 2 comprises valve means 4, a first conduit means 6, a second conduit means 8 and a third conduit means 10.

The valve means 4 comprises a body 12 having a first chamber 14. This first chamber 14 has a first port 16 formed as one end of a first nipple 17. The first chamber 14 also has a second port 18 formed as one end of passageway means 19. As shown, the passageway means 19 is formed in the valve body 12. The valve means 4 has first obturator means in the form of a flap operating obturator device 20 for opening and closing the second port 18.

Figure 2:
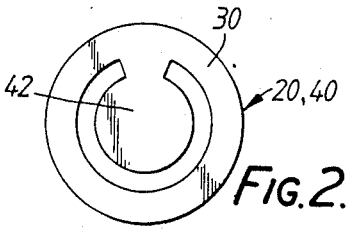
FIG. 2 shows in detail a first or a second obturator means as employed in FIG. 1.

The valve means 4 also comprises a second chamber 34. The second chamber 34 has a third port 36 formed as one end of a second nipple 37. The second chamber 34 also has a fourth port 38 formed as another end of the passageway means 19. Second obturator means in the form of a flap operating obturator device 40 is provided for closing the fourth port 38 as illustrated. The device 40 is the same as the device 20 illustrated in FIG. 2.

The valve body 12 has a main body part 22 and a pair of end members 24,26. These end members 24,26 push into the main body part 22 and they are a sufficiently tight fit therein to trap the periphery 30 of each of the devices 20,40 as shown in FIG. 1. With the devices 20,40 so trapped, the flap portion 42 of each device 20,40 is able to move to and fro to block or open the second and fourth ports 18,38 that are in the valve body 12.

The second and the fourth ports 18,38 extend into passageways 18A and 38A as shown, and these passages 18A and 38A are connected to a common passage 43. The outer end of the common passage 43 is enlarged as shown to receive one end of a nipple 45.

As shown in FIG. 1, the first conduit means 6 is used to connect the first port 16, via the nipple 17, to an engine inlet manifold 44 just below an engine carburettor 46. The third conduit means 10 is used to connect the third port 36, via the nipple 37, to the carburettor 46. The carburettor 46 is provided with a butterfly valve 48. The second conduit means 8 is used to connect the second and the fourth ports 18,38, via the nipple 45, to an engine distributor arrangement 50 which comprises an electrical distributor 51 and a vacuum advance potentiometer 53.

As thus far described, it will be apparent that the vacuum operated apparatus 2 is such that in use the valve means 4 can receive first vacuum forces from the inlet manifold 44 via the first conduit means 6, and second vacuum forces from the carburettor 46 via the third conduit means 10. As will be described in greater detail hereinbelow, the valve means 4 is operative to transmit the greater of the first and the second vacuum forces via the second and the first ports 18, 38, the nipple 45 and the second conduit means 8 to the engine distributor arrangement 50, so that the engine distributor arrangement 50 always receives the optimum vacuum force for causing the optimum adjustment of the engine distributor arrangement 50 to give the optimum engine ignition timing during engine operating conditions.

The vacuum operated apparatus 2 may be used with engines that run on liquid fuel or with engines that run on gaseous fuel.

When starting the engine, a very high vacuum will soon be produced in the inlet manifold 44. The idling speed of the engine should be re-adjusted accordingly. The vacuum from the manifold 44 passes along the first conduit means 6 and reaches the nipple 17. The vacuum passes into the first chamber 14 through the first port 16 and opens the flap portion 42 of the device 20. The device 20 will normally be made of rubber so that it will be appreciated that the flap portion 42 just pivots away from the position shown in FIG. 1. The vacuum from the manifold 44 then passes along the passages 18A, 38A and moves the flap portion 42 of the device 40 to close the fourth port 38. This will be effective to shut off the lower vacuum source that comes to the fourth port 38 from the carburettor 46 via the third conduit means 10, the nipple 37 and the third port 36. With the device 40 shutting the fourth port 38, one of the functions of the valve means 4 is completed. The vacuum will accumulate and according to its variable intensity, it will cause the distributor 50 to operate to advance the spark in the engine.

The intensity of the vacuum in the manifold 44 decreases in inverse proportion to the acceleration of the engine. The vacuum from the carburettor 46 increases in direct proportion to the acceleration of the engine, whilst retaining its variance according to torque requirements. As the vacuum increases in the carburettor 46, any slight increase in this vacuum will be felt along the third conduit means 10 and at the third port 36. This will cause the device 40 to open since the increased vacuum in the second chamber 34 will suck the flap portion 42 away from the fourth port 38. The vacuum from the carburettor 46 will then pass via the fourth port 38 and the passages 38A, 18A to the device 20. The suction will cause the flap portion 42 to pivot to close the second port 18. Thus, the distributor 50 will then be receiving vacuum forces from the carburettor 46 instead of from the manifold 44. The carburettor 46 will thus effectively have taken over the control of the distributor 50 to effect the required spark advancing function. This thus completes another of the functions of the valve means 4.

During the operation of the valve means 4, there may be times when the vacuums from the two sources of the inlet manifold 44 and the carburettor 46 may be in perfect balance and this may eliminate the difference needed for spark advancement via the distributor 50. An auxiliary air inlet means in the form of an air inlet port 56 is provided. The air inlet port 56 is provided in the valve body 12 as shown. The air inlet port 56 is effective to come into operation if the devices 20,40 should simultaneously be in their closed position. The air inlet port 56 is thus effective to eliminate any possible vacuum lock in the valve means 4, it avoids any substantial hesitation in the variation of the vacuum applied to the distributor 50, and it enables the smooth continuous advancement of the spark as required by engine requirements.

It will be appreciated that the valve means 4 operates as a flip flop logic check valve. Substantially no force is required to operate the valve means 4 and the entire vacuum operated apparatus 2 may be used for single or dual curve spark advancement. The vacuum operated apparatus 2 can be used for substantially any vacuum spark advancement system, whether the system requires liquid or gaseous fuel. The vacuum operated apparatus 2 can be installed without costly changes being required to the engine of the vehicle. As mentioned above, the vacuum operated apparatus 2 may be effective to increase the horse power of the engine and also to reduce fuel consumption.

The area of improvement afforded by the vacuum operated apparatus 2 of the present invention is substantially the same as that shown and described in FIG. 6 of the above mentioned U.S. Pat. No. 4,622,937, which description is incorporated herein by reference.

The vacuum operated apparatus 2 can be made from various materials so that, for example, the valve means 4 can be die cast from an aluminium alloy or it can be injection moulded from a plastics material.

The vacuum operated apparatus 2 can be used on its own for modifying engines as described above. The vacuum operated apparatus 2 is however especially advantageous when it is used in conjunction with the devices described and claimed in Canadian patent Nos. 1113808, 1156107 and 1191755 to David T. Szloboda. These patents describe and claim systems for enabling engines to operate on liquid fuel or gaseous fuel as may be required by a driver of a vehicle.

It is to be appreciated that the embodiment of the invention described above has been given by way of example only and that modifications may be effected. Thus, for example, a different type of first and second obturator means may be employed to the flap operating obturator devices 20,40.

I claim:

1. Vacuum operated apparatus for controlling the ignition timing of an engine, which apparatus comprises valve means and first, second and third conduit means, the valve means comprising a valve body, a first chamber, first and second ports in the first chamber, first obturator means for opening and closing the second port, a second chamber, third and fourth ports in the second chamber, and second obturator means for opening and closing the fourth port, and passageway means which connects together inside the valve body the second and the third ports, the first conduit means being for connecting the first port to an engine inlet manifold, the third conduit being for connecting the third port to an engine carburettor, and the second conduit means being for connecting the second and the fourth ports via the passageway means to an engine distributor arrangement, and the apparatus being such that in use the valve means receives first vacuum forces from the inlet manifold via the first conduit means and second vacuum forces from the carburettor via the third conduit means, the value means being operative to transmit the greater of the first and the second vacuum forces via the second and the fourth ports and the second conduit means to the engine distributor arrangement so that the engine distributor arrangement always receives the optimum vacuum force for causing the optimum adjustment of the engine distributor arrangement to give the optimum engine ingnition timing during engine operating conditions.

2. Vacuum operated apparatus according to claim 1 in which the first and the third ports are formed in first and third nipples, in which a second nipple is provided for the passageway means and the second and the fourth ports, and in which all of the nipples are such as to extend from the body of the valve means.

3. Vacuum operated apparatus according to claim 2 in which the first and the second obturator means are each a flap operating obturator device.

4. Vacuum operated apparatus according to claim 3 in which the valve body has a pair of end members which press into a main body part to close a pair of recesses in the body and thereby to form the first and the second chambers, the flap operating obturator devices each having a peripheral portion which is trapped between one of the pair of the end members and the main body part, and a flap part which operates one against each of a pair of open ends of the passageway means.

5. Vacuum operated apparatus according to claim 4 in which the first conduit means includes a valve for opening or closing the first conduit means.

6. Vacuum operated apparatus according to claim 5 in which the valve is an electrially operated valve.

7. Vacuum operated apparatus according to claim 4 and including auxiliary air inlet means.

8. Vacuum operated apparatus according to claim 7 in which the auxiliary air inlet means is an air inlet port provided in the valve means.

9. Vacuum operated apparatus according to claim 1 in which the engine distributor arrangement comprises an electrically operated distributor and a vacuum advance potentiometer, the second conduit means being for connection to the vacuum advance potentiometer.

* * * * *